US006626254B1

(12) United States Patent
Krueger et al.

(10) Patent No.: US 6,626,254 B1
(45) Date of Patent: Sep. 30, 2003

(54) DRILLING ASSEMBLY WITH A STEERING DEVICE FOR COILED-TUBING OPERATIONS

(75) Inventors: Volker Krueger, Celle; Thomas Kruspe, Wienhausen; Carsten Freyer, Hannover; Hans Jurgen Faber, Neustadt, all of (DE)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/711,213

(22) Filed: Nov. 9, 2000

Related U.S. Application Data

(63) Continuation of application No. 09/015,848, filed on Jan. 29, 1998, now abandoned.
(60) Provisional application No. 60/036,572, filed on Jan. 29, 1997.

(51) Int. Cl.[7] ..... E21B 7/06
(52) U.S. Cl. ..... 175/61; 175/76; 175/325.3
(58) Field of Search ..... 175/325.3, 104, 175/101, 107, 26, 61, 73, 76, 71

(56) References Cited

U.S. PATENT DOCUMENTS 4,463,814 A * 8/1984 Horstmeyer et al. ..... 175/61 X
5,603,386 A * 2/1997 Webster ..... 175/76
5,812,068 A * 9/1998 Wisler et al. ..... 340/855.5

* cited by examiner

*Primary Examiner*—David Bagnell
*Assistant Examiner*—Sunil Singh
(74) *Attorney, Agent, or Firm*—Madan, Mossman & Sriram, P.C.

(57) ABSTRACT

The present invention provides a drilling assembly for drilling deviated wellbores. The drilling assembly includes a drill bit at the lower end of the drilling assembly. A drilling motor provides the rotary power to the drill bit. A bearing assembly of the drilling motor provides lateral and axial support to the drill shaft connected to the drill bit. A steering device is integrated into drilling motor assembly. The steering device contains a plurality of force application members disposed at an outer surface of the drilling motor assembly. Each force application member is adapted to move between a normal position and a radially extended position to exert force on the wellbore interior when in extended position. A power unit in the housing provides pressurized fluid to the force application members. A control device for independently operating each of the force application members is disposed in the drilling motor assembly. A control circuit or unit independently controls the operation of the control device to independently control each force application member. For short radius drilling, a knuckle joint is disposed uphole of the steering device to provide a bend in the drilling assembly. During drilling of a wellbore, the force application members are operated to adjust the force on the wellbore to drill the wellbore in the desired direction.

16 Claims, 7 Drawing Sheets

DRILLING ASSEMBLY WITH A STEERING DEVICE FOR COILED-TUBING OPERATIONS

CROSS-REFERENCE TO RELATED APPLICATION

This application claims the benefit of earlier filed provisional U.S. patent application Ser. No. 60/036,572, filed on Jan. 29, 1997. This application is also a continuation of application Ser. No. 09/015,848, filed on Jan. 29, 1998, now abandoned.

BACKGROUND OF THE INVENTION

1. Field of the Invention

This invention relates generally to drill strings for drilling boreholes for the production of hydrocarbons and more particularly to a drilling assembly which utilizes a downhole controllable steering device for relatively accurate drilling of short-radius to medium-radius boreholes. The drilling assembly of the present invention is particularly useful with coiled-tubing operations.

2. Description of the Related Art

To obtain hydrocarbons such as oil and gas, boreholes or wellbores are drilled by rotating a drill bit attached to a drill string end. A large proportion of current drilling activity involves directional drilling, i.e., drilling deviated and horizontal boreholes, to increase the hydrocarbon production and/or to withdraw additional hydrocarbons from the earth's formations. More recently, demand for drilling short to medium radius wellbores has been increasing. The term "short radius wellbores" generally means wellbores with radii between 12 and 30 meters, while the term "medium radius wellbores" generally means wellbores with radii between 30 and 300 meters.

Modern directional drilling systems generally employ a drilling assembly that includes a drill bit at its bottom end, which is rotated by a drill motor (commonly referred to as the "mud motor") in the drilling assembly. The drilling assembly is conveyed into the wellbore by a coiled tubing. A fluid ("mud") under pressure is injected into the tubing which rotates the drilling motor and thus the drill bit. The state-of-the-art coiled-tubing drill conveyed drilling assemblies usually contain a drilling motor with a fixed bend and an orienting tool to rotate the high side of the drilling motor downhole in the correct direction. The currently available coiled-tubing drilling assemblies (systems) with such orienting tools are typically more than sixteen (16) meters long. Tools of such length are difficult to handle and difficult to trip into and out of the wellbore. Furthermore, such tools require long risers at the surface. Such orienting tools require relatively high power to operate due to the high torque of the drilling motor and the friction relating to the orienting tool.

To drill a short radius or medium radius wellbore it is highly desirable to be able to drill such wellbores with relative precision along desired or predetermined wellbore paths ("wellbore profiles"), and to alter the drilling direction downhole without the need to retrieve the drilling assembly to the surface. Drilling assemblies for use with coiled tubing to drill short-radius wellbores in the manner described above need a dedicated steering device, preferably near the drill bit, for steering and controlling the drill bit while drilling the wellbore. The device needs to be operable during drilling of the wellbore to cause the drill bit to alter the drilling direction.

The present invention provides drilling assemblies that address the above-noted needs. In one embodiment, the drilling assembly includes a steering device in a bearing assembly which is immediately above the drill bit. The steering device may be operated to exert radial force in any one of several directions to articulate the drill bit along a desired drilling direction. The steering assembly may be disposed at other locations in the drilling assembly for drilling medium radius wellbores. Devices and/or sensors are provided in the drilling assembly to continuously determine the drilling assembly inclination, azimuth and direction. Other measurement-while-drilling ("MWD") devices or sensors may be utilized in the drilling assembly, as is known in the drilling industry.

SUMMARY OF THE INVENTION

The present invention provides a drilling assembly for drilling deviated wellbores. The drilling assembly contains a drill bit at the lower end of the drilling assembly. A motor provides the rotary power to the drill bit. A bearing assembly disposed between the motor and the drill bit provides lateral and axial support to the drill shaft connected to the drill bit. A steering device integrated into the drilling motor, preferably in the bearing assembly provides direction control during the drilling of the wellbores. The steering device contains a plurality of ribs disposed at an outer surface of the bearing housing. Each rib is adapted to move between a normal position or collapsed position in the housing and a radially extended position. Each rib exerts force on the wellbore interior when in the extended position. Power units to independently control the rib actions are disposed in the bearing assembly. An electric control unit or circuit controls the operation of the power units in response to certain sensors disposed in drilling assembly. Sensors to determine the amount of the force applied by each of the ribs on the wellbore are provided in the bearing section. The electric control circuit may be placed at a suitable location above the drilling motor or in the rotating section of the drilling motor.

For drilling short radius wellbores, a knuckle joint or other suitable device may be disposed uphole of the steering device to provide a desired bend in the drilling assembly above the steering device. Electrical conductors are run from a power source above the motor to the various devices and sensors in the drilling assembly.

During drilling of a wellbore, the ribs start in their normal or collapsed positions near the housing. To alter the drilling direction, one or more ribs are activated, i.e., extended outwardly with a desired amount of force on each such rib. The amount of force on each rib is independently set and controlled. The rib force produces a radial force on the drill bit causing the drill bit to alter the drilling direction.

Examples of the more important features of the invention thus have been summarized rather broadly in order that the detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

For detailed understanding of the present invention, references should be made to the following detailed description of the preferred embodiment, taken in conjunction with the accompanying drawings, in which like elements have been given like numerals and wherein.

DESCRIPTION OF THE PREFERRED EMBODIMENT

In general, the present invention provides a drilling assembly for use with coiled tubings to drill wellbores. The drilling assembly includes a drilling motor having a power section and a bearing assembly that provides radial and axial support to the drill bit. A steering device integrated into the bearing assembly provides directional control in response to one or more downhole measured parameters. The steering device included a plurality of independently controlled force application members, which are preferably controlled by a control unit or processor in response to one or more downhole measured parameters and predetermined directional models provided to the control unit.

Figure 1A:
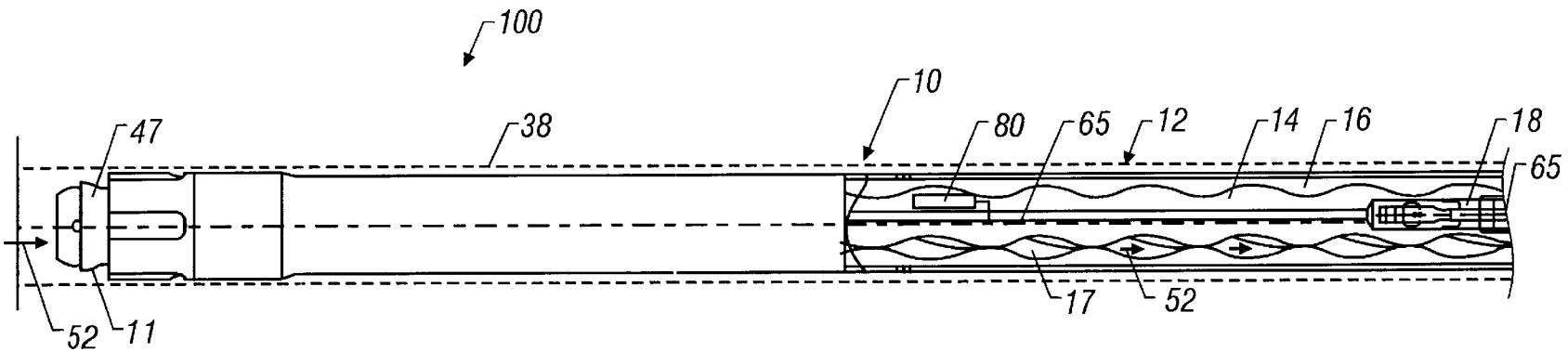
FIGS. 1A–1B show a cross-sectional view of a portion of the drilling assembly with the steering device and the control device disposed in the bearing assembly of the drilling assembly.
Figure 1B:
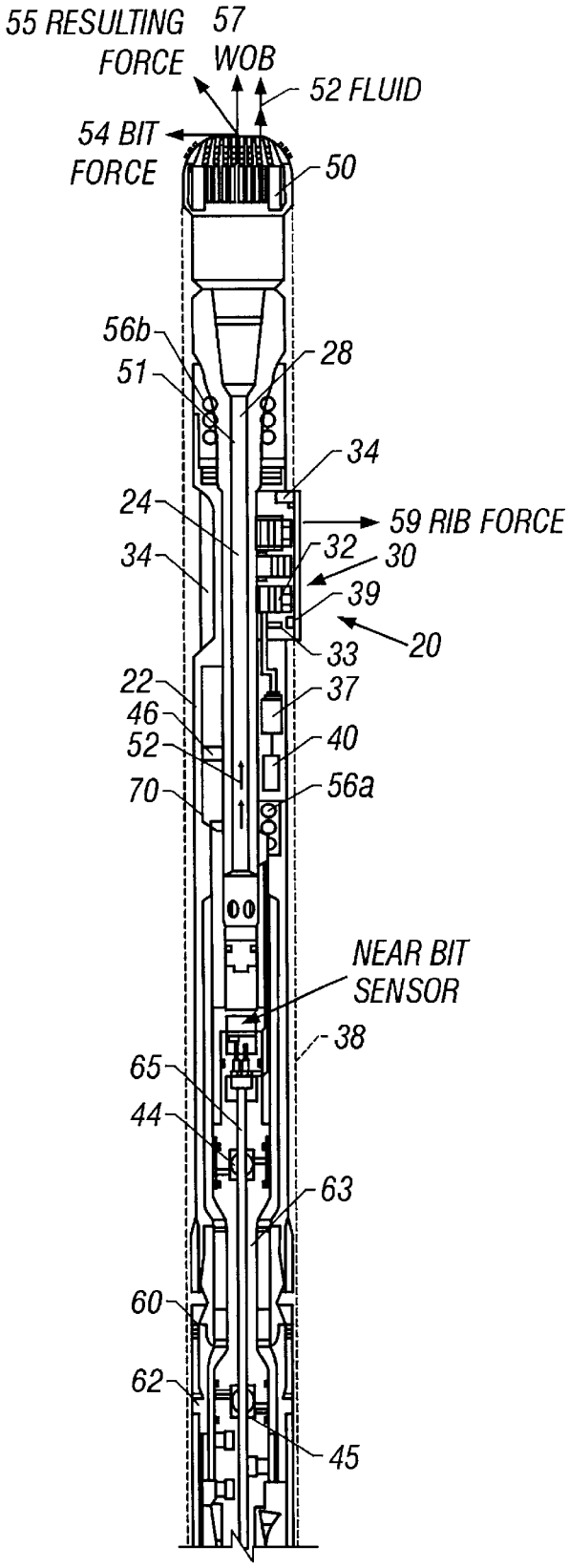
Figure 2:
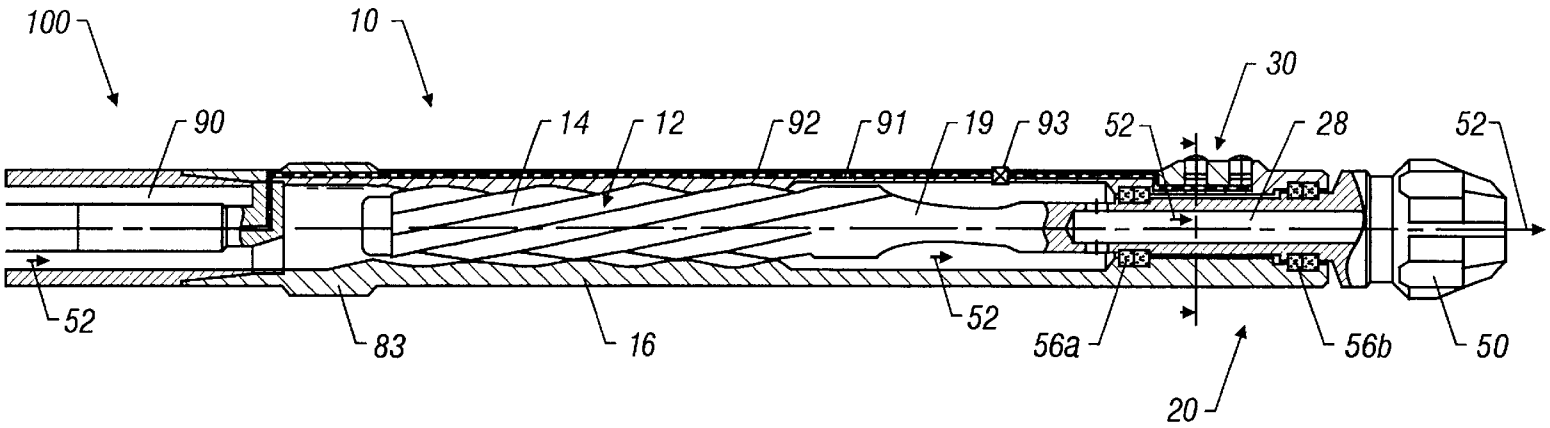
FIG. 2 is a schematic view of an alternative embodiment of a drilling assembly with steering members in the bearing assembly of the mud motor and the power and control devices for operating the steering members disposed above the mud motor.

FIGS. 1A–1B show a schematic diagram of a steering device 30 integrated into a bearing assembly 20 of a drilling motor 10. The drilling motor 10 forms a part of the drilling assembly 100 (FIG. 2). The drilling motor 10 contains a power section 12 and the bearing assembly 20. The power section 12 includes a rotor 14 that rotates in a stator 16 when a fluid 52 under pressure passes through a series of openings 17 between the rotor 14 and the stator 16. The fluid 52 may be a drilling fluid or "mud" commonly used for drilling wellbores or it may be a gas or a liquid and gas mixture. The rotor 14 is coupled to a rotatable shaft 18 for transferring rotary power generated by the drilling motor 10 to the drill bit 50.

The bearing assembly 20 has an outer housing 22 and a through passage 24. A drive shaft 28 disposed in the housing 22 is coupled to the rotor 14 via the rotatable shaft 18. The drive shaft 28 is connected to the drill bit 50 at its lower or downhole end 51. During drilling of the wellbores, drilling fluid 52 causes the rotor 14 to rotate, which rotates the shaft 18, which in turn rotates the drive shaft 28 and hence the drill bit 50.

The bearing assembly 20 contains within its housing 22 suitable radial bearings 56*a* that provide lateral or radial support to the drive shaft 28 and the drill bit 50, and suitable thrust bearings 56*b* to provide axial (longitudinal or along wellbore) support to the drill bit 50. The drive shaft 28 is coupled to the shaft 18 by a suitable coupling 44. The shaft 18 is a flexible shaft to account for the eccentric rotation of the rotor 14. Any suitable coupling arrangement may be utilized to transfer rotational power from the rotor 14 to the drive shaft 28. During the drilling of the wellbores, the drilling fluid 52 leaving the power section 12 enters the through passage 24 of the drive shaft 28 at ports or openings 46 and discharges at the drill bit bottom 53. Various types of bearing assemblies are known in the art and are thus not described in greater detail here.

Figure 1C:
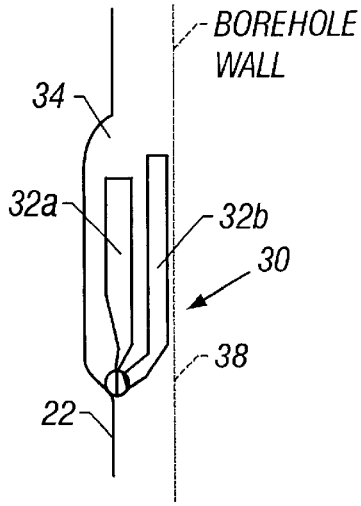
FIG. 1C shows a rib of the steering device of in FIG. 1A in an extended position.
Figure 1D:
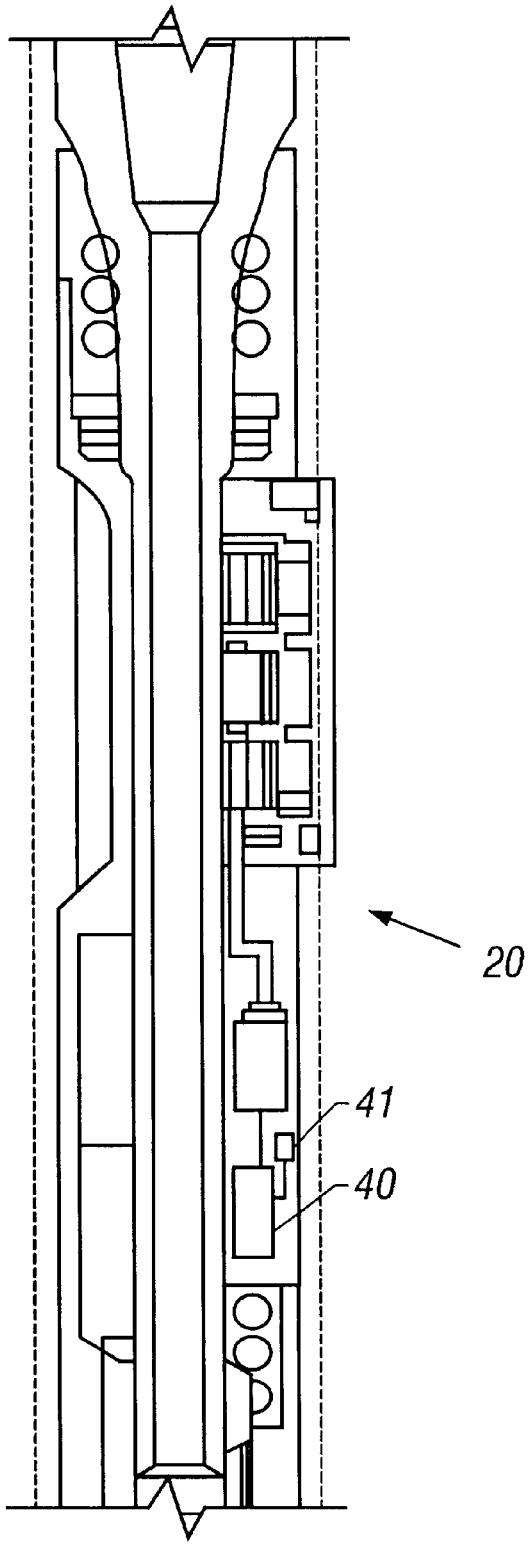
FIG. 1*d* is a schematic view cross-sectional side view of an alternate embodiment of a power unit for a pump.

In the preferred embodiment of FIGS. 1A–1B, a steering device, generally represented by numeral 30 is integrated into the housing 22 of the bearing assembly 20. The steering device 30 includes a number of force application members 32. Each force application member is preferably placed in a reduced diameter section 34 of the bearing assembly housing 22. The force application members may be ribs or pads. For the purpose of this invention, the force application members are generally referred herein as the ribs. Three ribs 32, equispaced around or in the outer surface of the housing 22, have been found to be adequate for properly steering the drill bit 50 during drilling operations. Each rib 32 is adapted to be extended radially outward from the housing 22. FIG. 1C shows a rib 32 in its normal position 32*a* (also referred to as the "retracted" or "collapsed" position) and in fully extended position 32*b* relative to the wellbore inner wall 38.

The operation of each steering rib 32 is independently controlled by a separate piston pump 40. For short radius drilling assemblies, each such pump 40 is preferably an axial piston pump 40 disposed in the bearing assembly housing 22. In one embodiment, the piston pumps 40 are hydraulically operated by the drill shaft 28 utilizing the drilling fluid 52 flowing through the bearing assembly 20. A control valve 33 is disposed between each piston pump 40 and its associated steering rib 32 to control the flow of the hydraulic fluid from such piston pump 40 to its associated steering rib 32. Each control valve 33 is controlled by an associated valve actuator 37, which may be a solenoid, magnetostrictive device, electric motor, piezoelectric device or any other suitable device. To supply the hydraulic power or pressure to a particular steering rib 32, the valve actuator 37 is activated to provide hydraulic power to the rib 32. If the valve actuator 37 is deactivated, the check valve is blocked, and the piston pump 40 cannot create pressure in the rib 32. During drilling, all piston pumps 40 are operated continuously by the drive shaft 28. In one method, the duty cycle of the valve actuator 37 is controlled by processor or control circuit 80 disposed at a suitable place in the drilling assembly 100. FIG. 1A shows the control circuit 80 placed in the rotor 14 to conserve space. The control circuit may be placed at any other location, including at a location above the power section 12. Instead of using the hydraulic power to operate the pumps 40, each pump 40 may be operated by electric motors (not shown) suitably disposed in the bearing assembly 20. A separate electric motor may be operably connected to each pump. Each of the electric motors can be configured to control a linear motion of pump to move the rib between a normal or collapsed position 32*a* and an extended position 32*b*.

Still referring to FIGS. 1A–1B, it is known that the drilling direction can be controlled by applying a force on the drill bit 50 that deviates from the axis of the borehole tangent line. This can be explained by use of a force parallelogram depicted in FIG. 1A. The borehole tangent line is the direction in which the normal force (or pressure) is applied on the drill bit 50 due to the weight on bit, as shown by the arrow WOB 57. The force vector that deviates from this tangent line is created by a side force applied to the drill bit 50 by the steering device 30. If a side force such as that shown by arrow 59 (Rib Force) is applied to the drilling assembly 100, it creates a force 54 on the drill bit 50 (Bit Force). The resulting force vector 55 then lies between the weight on bit force line (Bit Force) depending upon the amount of the applied Rib Force.

In the present invention, each rib 32 can be independently moved between its normal or collapsed position 32*a* and an extended position 32*b*. The required side force on the drilling assembly is created by activating one or more of the ribs 32. The amount of force on each rib 32 can be controlled by controlling the pressure on the rib 32. The pressure on each rib 32 is preferably controlled by proportional hydraulics or by switching to the maximum pressure (force) with a controlled duty cycle. The duty cycle is controlled by controlling the operation of the valve actuator 37 by any known method.

The use of axial piston pumps 40 enables disposing such pumps 40 in the bearing assembly and relatively close to the ribs 30. This configuration can reduce the overall length of the drilling assembly. Placing the ribs 32 in the housing 22 of the bearing assembly 20 aids in drilling relatively shorter radius boreholes. The above-described arrangement of the steering device 30 and the ability to independently control the pressure on each rib 32 enables steering the drill bit 12 in any direction and further enables drilling the borehole with a controlled build-out rate (deviation angle). Preferably a separate sensor 39 is provided in the bearing assembly 20 to determine the amount of force applied by each rib 32 to the borehole interior 38. The sensor 39 may be a pressure sensor, a position measuring sensor or a displacement sensor. The processor 80 processes the signals from the sensor 39 and in response thereto and stored information or models controls the operation of each rib 32 and thus precisely controls the drilling direction.

To achieve higher build-up rates ("BUR"), such as rates of more than 60°/100 feet, a knuckle joint 60 may be disposed between the motor power section 14 and the steering devices 30. The knuckle joint 60 is coupled to the bearing assembly 20 at the coupling 44 and to the shaft 28 with a coupling joint 45. The knuckle joint 60 can be set at one or more bent positions 62 to provide a desired bend angle between the bearing assembly 20 and the motor power section 14. The use of knuckle joints 60 is known in the art and thus is not described in detail herein. Any other suitable device for creating the desired bend in the drilling assembly 100 may be utilized for the purpose of this invention.

Electric conductors 65 are run from an upper end 11 of drilling motor 10 to the bearing assembly 20 for providing required electric power to the valve actuators 39 and other devices and sensors in the drilling motor 10 and to transmit data and signals between the drilling motor 10 and other devices in the system. The rotor 14 and the shaft 28 may be hollow to run conductors 65 therethrough. Appropriate feed-through connectors or couplings, such as coupling 63, are utilized, where necessary, to run the electric conductors 65 though the drilling motor 10. An electric slip ring device 70 in the bearing assembly 20 and a swivel (not shown) at the top of the power section 12 is preferably utilized to pass the conductors 65 to the non-rotating parts in the bearing assembly 20. Electric swivel and slip rings may be replaced by an inductive transmission device. The devices and sensors such as pressure sensors, temperature sensors, sensors to provide axial and radial displacement of the drill shaft 28 are preferably included in the drilling motor 10 to provide data about selected parameters during drilling of the boreholes.

FIG. 2 is a schematic view of an alternative embodiment of a drilling assembly 100 with steering members 30 in the bearing assembly 20 of the mud motor 10 and the power and control devices 90 for operating the steering members 30 disposed above the power section 12 of the mud motor 10. In this configuration the rotor 14 is coupled to the drill shaft 28 by a suitable coupling or flexible shaft 19. A common housing 92 with or without connection joints 93 may be used to house the stator 16, coupling 19 and the bearing assembly 20. A separate fluid line 91 is run from a source of hydraulic power in section 90 to each of the individual force application members 30 through the housing 92. The section 90 contains the pumps and the control valves and the required control circuits to independently control the operation of each of the ribs 30. This configuration is simpler than the configuration that contains the power and/or control devices in the mud motor 10, more reliable as it does not require using mechanical and electrical connections inside the bearing housing 22. It also enables building reduced overall length mud motors 10 compared to the configuration shown in FIG. 1. The configuration of FIG. 2 allows drilling of the wellbores with a higher build up rate compared due the proximity of the ribs 30 near the drill bit 50 and the shorter length of the drilling motor 10. A stabilizer 83 is provided at a suitable location uphole of the ribs 30 to provide lateral stability to the drilling assembly 100. Alternatively, a second set of ribs 30 may be incorporated into the drilling assembly as described below.

Figure 3:
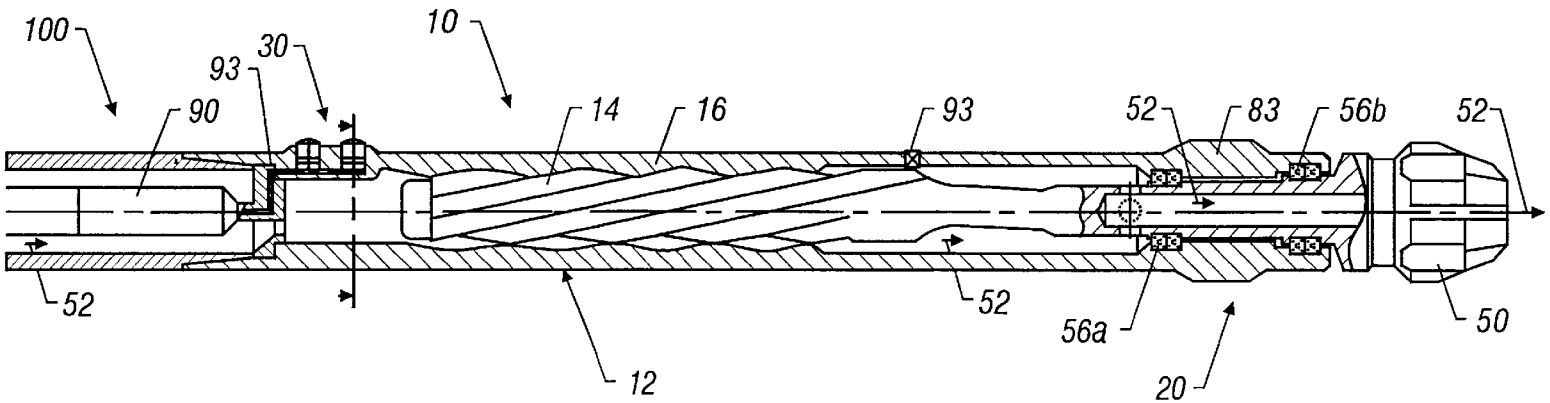
FIG. 3 is a schematic view of an alternative embodiment of a drilling assembly with steering members and the power and control devices for operating the steering members disposed above the mud motor.

FIG. 3 is a schematic view of drilling assembly configuration wherein the ribs 30 are placed above the mud motor 10 and the power unit and the control devices to control the operation of the ribs is disposed in a suitable section above the mud motor 10. A hydraulic line 93 provides the fluid to the ribs 30. The operation of the steering devices shown in FIGS. 2 and FIG. 3 are similar to the operation of the embodiment of FIGS. 1A–1C. In yet another configuration, the ribs 30 may be placed in the bearing assembly 20 as shown in FIG. 2 and also above the motor 10 as shown in FIG. 3. In such a configuration, a separate line is run for each of the ribs. A common control circuit and a common hydraulic power unit may be used for all the ribs with each rib having a separate associated control valve. This configuration allows control of the drilling direction at multiple location on the drilling assembly.

Figure 4:
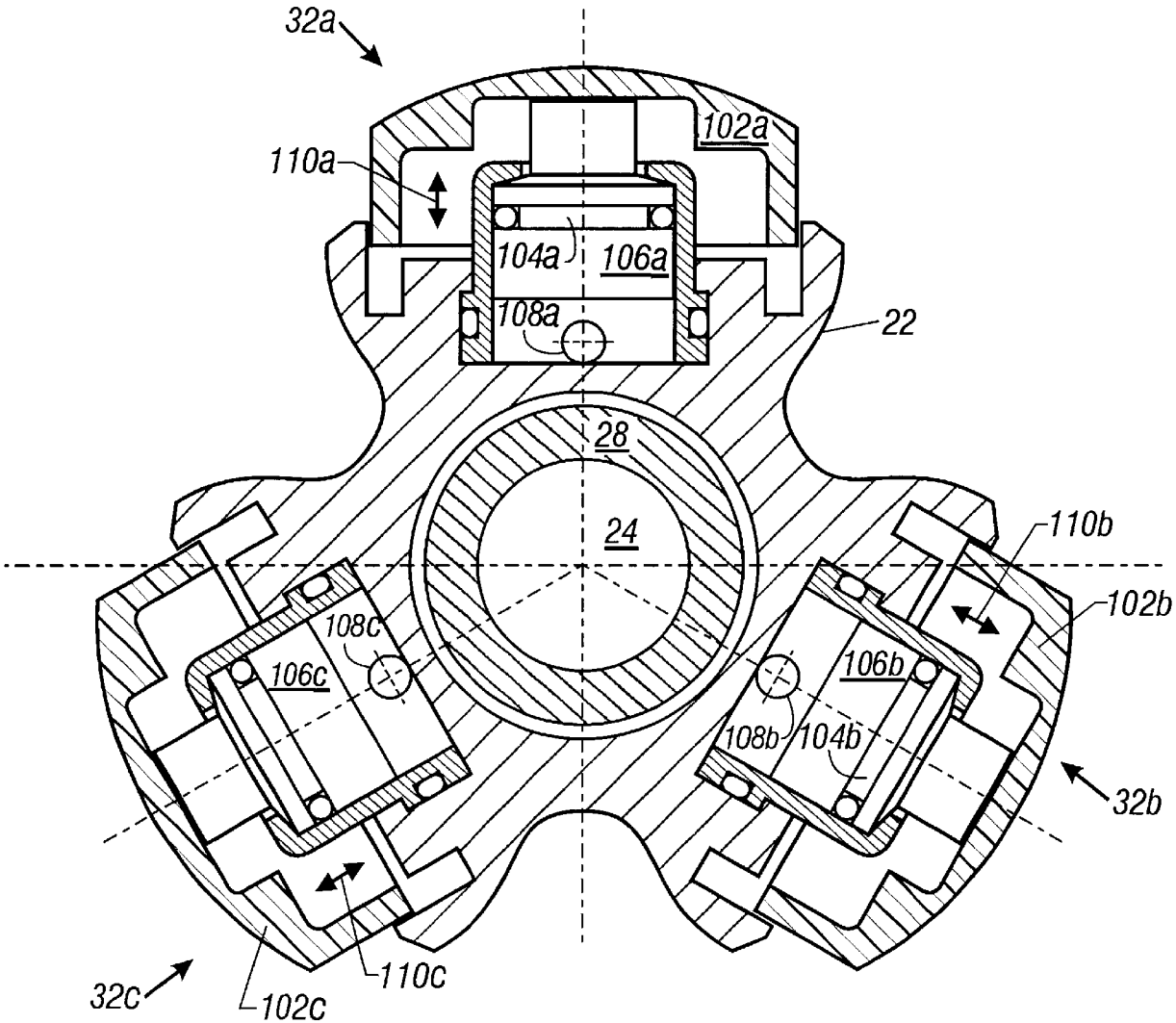
FIG. 4 is a schematic view of a configuration of the steering members disposed around a non-rotating housing for use in the steering devices of FIGS. 1–3.
Figure 5:
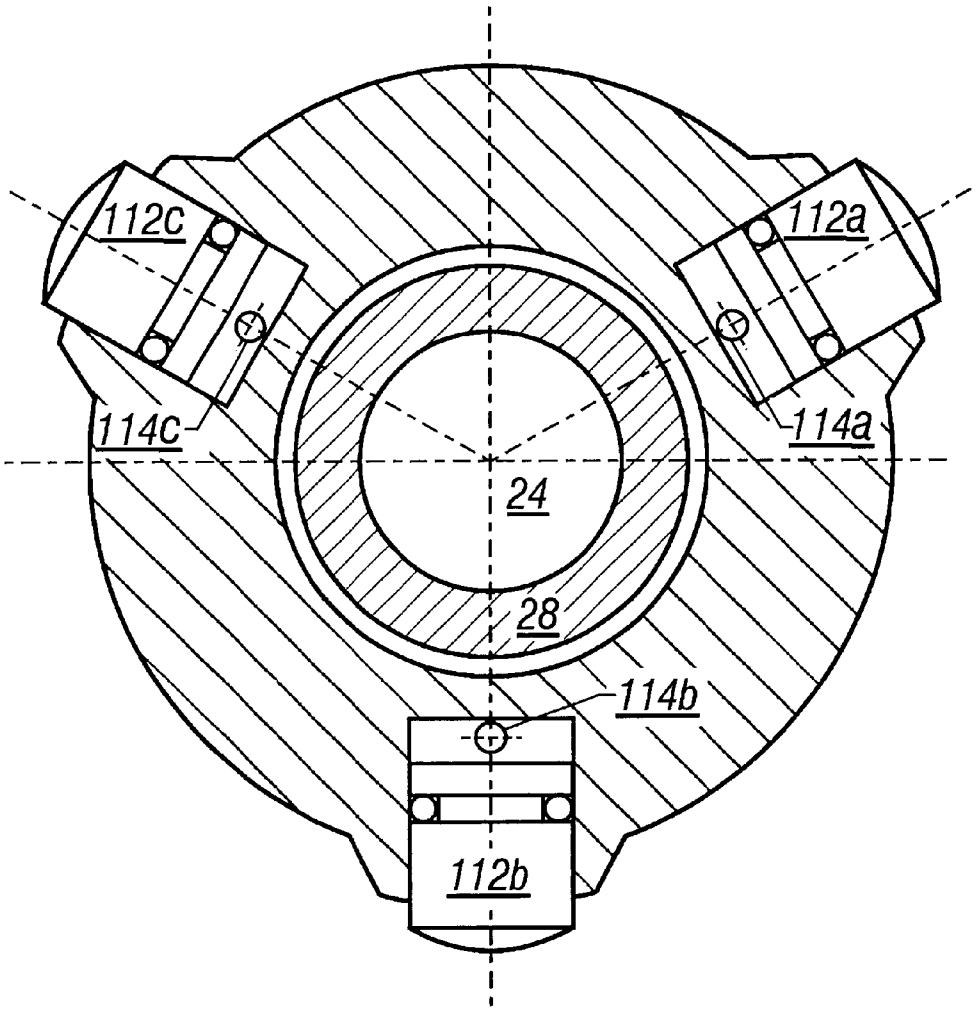
FIG. 5 is a schematic view of an alternative configuration of the steering members disposed around a non-rotating housing for use in the steering devices of FIGS. 1–3.

FIG. 4 is a schematic view of a configuration showing three force application members 32*a*–32*c* disposed around the non-rotating housing 22 of the bearing assembly 20 of FIGS. 1–3. The configuration of FIG. 4 shows three force application members 32*a*–32*c* placed spaced apart around the periphery of the bearing assembly housing 22. The force application members 32*a*–32*c* are identical and thus the configuration and operation thereof is described with respect to only the member 32*a*. The force application member 32*a* includes a rib member 102*a* that is radially movable as shown by the arrows 110*a*. A hydraulically-operated piston 104*a* in a chamber 106*a* acts on the rib member 102*a* to moves the rib member 102*a* outward to cause it to apply force to the wellbore. The fluid is supplied to the chamber 106*a* from its associated power source via a port 108*a*. As described earlier, each force application member is independently operated to control the amount of the force exerted by such member to the wellbore inside, which allows precisely controlling the drilling direction of the wellbore. The force application members 32*b* and 32*c* respectively include pistons 104*b* and 104*c*, chambers 106*b* and 106*c* and inlet ports 108*b* and 108*c* and they move in the directions shown by the arrows 110*b* and 110*c*. FIG. 5 is a schematic view of an alternative configuration of the steering members. This configuration differs from the configuration of FIG. 4 in that it does not have the rib members. The pistons 112*a*–112*c* directly apply the force on the wellbore walls the pistons are extended outward.

Figure 6:
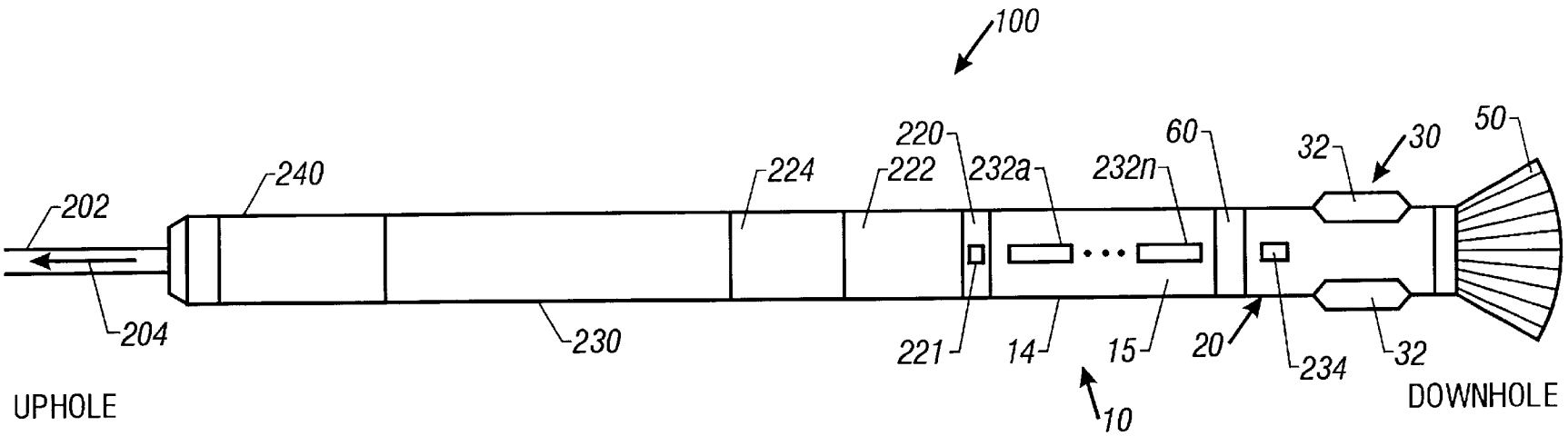
FIG. 6 is a schematic drawing of an embodiment of the drilling assembly according to the present invention.

FIG. 6 shows a configuration of a drilling assembly 100 utilizing the steering device 30 (see FIGS. 1A–1B) of the present invention in the bearing assembly 20 coupled to a coiled tubing 202. The drilling assembly 100 has the drill bit 50 at the lower end. As described earlier, the bearing assembly 20 above the drill bit 50 carries the steering device 30 having a number of ribs that are independently controlled to exert desired force on the drill bit 50 during drilling of the boreholes. An inclinometer (z-axis) 234 is preferably placed near the drill bit 50 to determine the inclination of the drilling assembly. The mud motor 10 provides the required rotary force to the drill bit 50 as described earlier with reference to FIGS. 1A–1B. A knuckle joint 60 may be provided between the bearing assembly 20 and the mud motor 10. Depending upon the drilling requirements, the knuckle joint 60 may be omitted or placed at another suitable location in the drilling assembly 100. A number of desired sensors, generally denoted by numerals 232*a*–232*n* may be disposed in a motor assembly housing 15 or at any other suitable place in the assembly 100. The sensors 232–232*n* may include a resistivity sensor, a gamma ray detector, and sensors for determining borehole parameters such as temperature and pressure, and drilling motor parameters such as the fluid flow rate through the drilling motor 10, pressure drop across the drilling motor 10, torque on the drilling motor 10 and speed of the motor 10.

The control circuit 80 may be placed above the power section 12 to control the operation of the steering device 30. A slip ring transducer 221 may also placed in the section 220. The control circuits in the section 220 may be placed in a rotating chamber which rotates with the motor. The drilling assembly 100 may include any number of other devices. It may include navigation devices 222 to provide information about parameters that may be utilized downhole or at the surface to control the drilling operations and/or devices to provide information about the true location of the drill bit 50 and/or the azimuth. Flexible subs, release tools with cable bypass, generally denoted herein by numeral 224, may also be included in the drilling assembly 100. The drilling assembly 100 may also include any number of additional devices known as the measurement-while-drilling devices or logging-while-drilling devices for determining various borehole and formation parameters, such as the porosity of the formations, density of the formation, and bed boundary information. The electronic circuitry that includes microprocessors, memory devices and other required circuits is preferably placed in the section 230 or in an adjacent section (not shown). A two-way telemetry 240 provides two-way communication of data between the drilling assembly 100 and the surface equipment. Conductors 65 placed along the length of the coiled-tubing may be utilized to provide power to the downhole devices and the two-way data transmission.

The downhole electronics in the section 220 and/or 230 may be provided with various models and programmed instructions for controlling certain functions of the drilling assembly 100 downhole. A desired drilling profile may be stored in the drilling assembly 100. During drilling, data/signals from the inclinometer 234 and other sensors in the sections 222 and 230 are processed to determine the drilling direction relative to the desired direction. The control device, in response to such information, adjusts the force on force application members 32 to cause the drill bit 50 to drill the wellbore along the desired direction. Thus, the drilling assembly 100 of the present invention can be utilized to drill short-radius and medium radius wellbores relatively accurately and, if desired, automatically.

The foregoing description is directed to particular embodiments of the present invention for the purpose of illustration and explanation. It will be apparent, however, to one skilled in the art that many modifications and changes to the embodiment set forth above are possible without departing from the scope and the spirit of the invention. It is intended that the following claims be interpreted to embrace all such modifications and changes.

What is claimed is:

1. A coiled tubing conveyed drilling assembly for use in drilling of a wellbore, comprising:

(a) a drilling motor for generating a rotary force in response to the flow of a drilling fluid through the drilling motor; and (b) a steering device integrated into the drilling motor for altering the drilling direction of the drilling assembly, said steering device including:

(i) a plurality of force application members arranged around a section of the drilling motor, each said force application member extending radially outward from the drilling motor to apply force to the wellbore inside, upon the application of power thereto;

(ii) a separate power unit operably coupled to each force application member, said separate power units being disposed in said drilling motor and supplying power to an associated said force application member; and (iii) a separate control device for controlling the supply of the power to the force application members.

2. The drilling assembly according to claim 1, wherein each said power unit includes a pump for supplying pressurized fluid to the force application members.

3. The drilling assembly according to claim 1, wherein each said power unit includes a separate electric motor associated with each control device, each said electric motor controlling a linear motion of its control device to move the force application member between a normal position and an extended position.

4. The drilling assembly according to claim 1, further comprising a control circuit for controlling the operation of the control devices.

5. The drilling assembly according to claim 4, wherein the control circuit is placed in a rotating part of the drilling motor.

6. The drilling assembly according to claim 1, wherein the drilling motor includes a power section and a bearing assembly and wherein the steering device is integrated in the bearing assembly.

7. The drilling assembly according to claim 1, wherein each said power unit includes a pump for supplying a pressurized fluid to each of the force application members to move each said force application member between a normal position and a radially-extended position.

8. The drilling assembly according to claim 1, wherein each control device is a fluid control valve.

9. The drilling assembly according to claim 8 further comprising a valve actuator for each said control valve for controlling the operation of such control valve.

10. The drilling assembly according to claim 9, wherein the valve actuator is selected from a group consisting of (a) a magnetostrictive device; (b) an electric motor; and (c) a piezoelectric device.

11. The drilling assembly according to claim 10, wherein the valve actuator is duty cycled to control the supply of a pressurized fluid to its associated force application member.

12. The drilling assembly according to claim 1, wherein each said power unit is operated by one of (a) a rotating shaft associated with the drilling motor, and (b) an electric motor.

13. The drilling assembly according to claim 1, wherein the drilling fluid is selected from a group of fluids consisting of a (i) liquid, (ii) gas, and (iii) liquid-gas mixture.

14. The drilling assembly according to claim 1, wherein each said power unit supply a pressurized fluid, and wherein each force application member includes a piston that radially moves a rib member of the force application member upon receiving the pressurized fluid from each said power unit.

15. The drilling assembly according to claim 1 further having a sensor associated with each force application member for providing signals indicative of the position of each such force application member relative to a reference position.

16. The drilling assembly according to claim 15 wherein each said separate control device independently controls the operation of each force application member in response to the measurements of the sensors and according to instructions provided thereto.

* * * * *